United States Patent [19]

Lindemann et al.

[11] Patent Number: 4,573,386

[45] Date of Patent: Mar. 4, 1986

[54] SAW CHAIN FOR A POWER-DRIVEN CHAIN SAW

[75] Inventors: Bernd Lindemann, Schwaikheim; Götz Landwehr, Berglen-Rettersburg; Hans-Georg Kaiser, Köngen, all of Fed. Rep. of Germany

[73] Assignee: Andreas Stihl, Waiblingen, Fed. Rep. of Germany

[21] Appl. No.: 510,352

[22] Filed: Jul. 1, 1983

[30] Foreign Application Priority Data

Jul. 7, 1982 [DE] Fed. Rep. of Germany ..... 3235317

[51] Int. Cl.[4] ..... B27B 33/14

[52] U.S. Cl. ..... 83/833; 83/832; 83/834

[58] Field of Search ..... 83/833, 834, 831, 832, 83/830

[56] References Cited

U.S. PATENT DOCUMENTS

| | | | |
|---|---|---|---|
| 2,902,068 | 9/1959 | Gudmundsen | 83/834 |
| 3,189,064 | 6/1965 | Frederickson | 83/834 |
| 3,625,266 | 12/1971 | Kennemore | 83/830 |

*Primary Examiner*—Donald R. Schran

*Attorney, Agent, or Firm*—Walter Ottesen

[57] ABSTRACT

The invention is directed to a saw chain for a power-driven chain saw. The saw chain includes a plurality of cutting links, a plurality of connecting links and a plurality of driving links. The links are interconnected by rivets to define the saw chain. The cutting links include a cutting tooth and a rearward foot defining a tilt edge. The cutting link tilts about the tilt edge when the cutting tooth penetrates the wood to be cut. In tilting about the tilt edge, the cutting edge of the cutting tooth is raised from a first elevation to a second elevation and the difference between these elevations is the tilt displacement. The tilt edge lies in a vertical plane which is perpendicular to a traverse plane containing the axes defined by the forward and rearward openings for the linkage rivets connecting the cutting link to the rest of the saw chain. The tilt edge is formed on the rearward foot at a location thereon such that the vertical plane lies within the forward half of the cutting tooth thereby reducing the tilt displacement to a predetermined magnitude. Accordingly, during the cutting operation of the saw chain, the tilt displacement is small and the cutting tooth does not draw itself into the wood to too great an extent whereby a more uniform cutting action by the cutting teeth of the cutting links is achieved and vibration of the saw chain is reduced.

22 Claims, 9 Drawing Figures

SAW CHAIN FOR A POWER-DRIVEN CHAIN SAW

FIELD OF THE INVENTION

The invention relates to a saw chain for a power-driven chain saw.

BACKGROUND OF THE INVENTION

Saw chains include cutting links which are connected alternately on the left and right sides of the chain. The cutting links are connected with center drive links and side connecting links by means of linkage rivets.

When work is performed with a saw chain having conventional cutting links, a force component acts on the cutting link in the direction opposite to the movement of the saw chain around the cutter bar when the cutting links penetrate the wood to be cut. This force component causes the cutting link to become raised by tilting about the tilt edge of the rearward foot of the link and, because of the geometry of the cutting link, the cutting link is drawn by its own cutting action into the wood. During this cutting action, the thickness of the cut chip becomes larger as does the magnitude of the force component.

The cutting links which are drawn into the wood require a larger amount of energy during their cutting action so that a correspondingly less amount of energy is available for the remaining cutting links. This leads to an impulse-like, irregular loading of the saw chain as well as to intense vibrations thereby imposing the saw chain and the cutter bar to severe mechanical stress and strain. These disadvantages become ever more intense the larger that the tilt displacement of the cutting edge is above its initial position before entering the wood.

The tilt displacement of the known cutting links is especially large because the rearward tilt edge lies beneath the rearward portion of the cutting tooth and the cutting edge lies approximately at the mid line of the body of the cutting link. As a consequence of the large tilt displacement, the cutting link tilts considerably during the tilting action and penetrates deeply into the wood.

SUMMARY OF THE INVENTION

It is an object of the invention to provide a saw chain with which a reduced vibration and quieter cutting operation is obtained.

The saw chain of the invention is utilized in power-driven chain saws having a cutter bar defining a track for accomodating and guiding the saw chain.

The saw chain includes: a plurality of cutting links, a plurality of connecting links, and a plurality of driving links, the links being pivotally interconnected by rivets or the like to define the saw chain.

The cutting links include: a plate-like body having a rearward wall defining a rearward opening for accomodating one of the rivets and a forward wall defining a forward opening for accomodating an other one of the rivets, the openings defining respective linkage axes about which the cutting link pivots relative to the respective links to which it is directly connected. The linkage axes defines a plane transverse to the plate-like body. The rearward wall has an upwardly extending bent-over top portion defining the cutting tooth of the cutting link and a downwardly extending portion defining the rearward foot of the cutting link, the cutting tooth being elongated and having a forward end defining the cutting edge thereof. The forward wall has an upwardly extending portion defining the depth limiter of the cutting link and has a downwardly extending portion defining the forward foot of the cutting link. The cutting edge is at a first elevation with respect to the cutter bar when both of the feet are in sliding contact with the base of the track of the cutter bar. The rearward foot defines a tilt edge or tilt point about which the cutting link tilts to displace the cutting edge to a second elevation above the first elevation when said cutting tooth penetrates the wood to be cut, the difference between the elevations being the tilt displacement of said cutting edge, the tilt edge lying in a vertical plane approximately perpendicular to the transverse plane. The tolt edge is formed on the rearward foot at a location thereon such that said vertical plane lies within the forward half of the cutting tooth thereby reducing the tilt displacement to a predetermined magnitude.

To bring the tilt edge as close as possible to the cutting edge in the cutting link of the saw chain of the invention, either the cutting edge can be placed further rearward or, the tilt edge can be displaced forward in the direction toward the cutting edge. In each instance, the vertical plane containing the tilt edge passes through the forward portion of the cutting tooth so that the tilt displacement is substantially smaller than with a conventional cutting link. The tilt displacement associated with the tilting action of the cutting links is therefore reduced and the depth of penetration of the cutting links into the wood is also reduced. The reduced tendency of the cutting link of the saw chain of the invention to draw itself into the wood during the cutting action leads to the beneficial result that the cutting force of the saw chain is distributed over many cutting links and therefore acts uniformly on the links of the saw chain. In this way, the vibration of the chain is significantly reduced and a more uniform chip thickness can be obtained.

It is a further advantage of the invention to reduce the tendency of the saw chain to produce an unwanted kickback of a power-driven chain saw. This advantage and other features of the invention are described in the following detailed description, the drawing and the appended claims.

BRIEF DESCRIPTION OF THE DRAWING

The invention will now be described with reference to the drawing wherein.

DESCRIPTION OF THE PREFERRED EMBODIMENTS OF THE INVENTION

Figure 2:
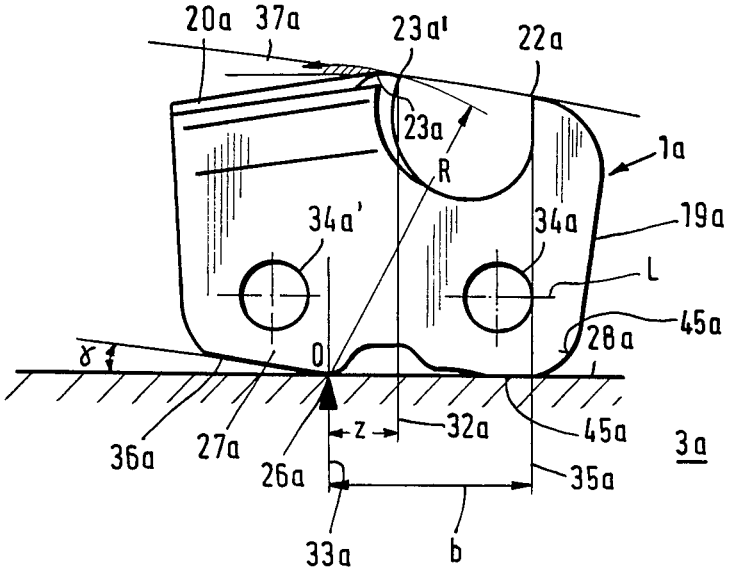
Figure 6:
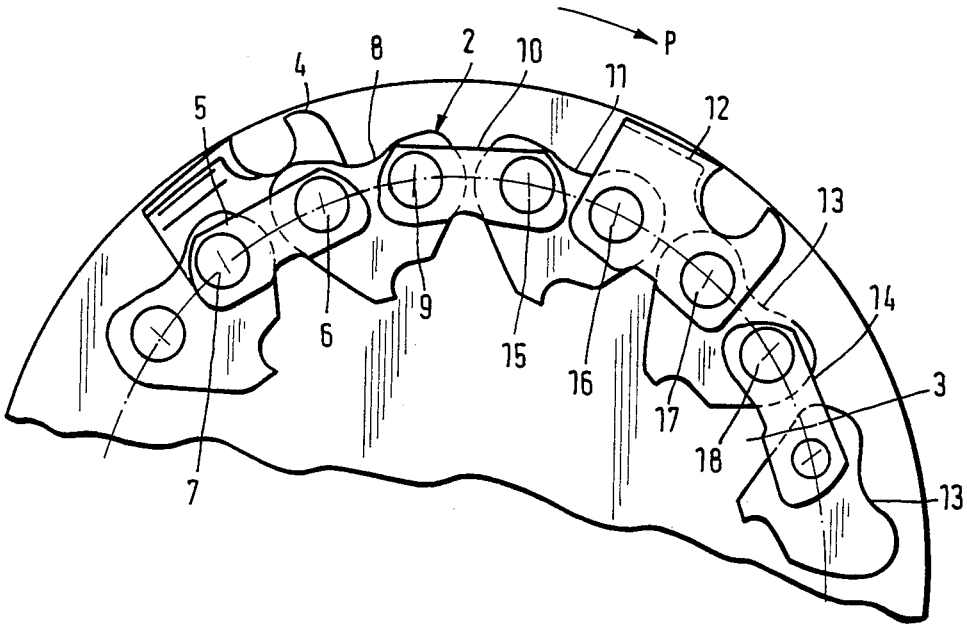
FIG. 6 shows a chain equipped with the cutting link of FIG. 2 as it moves over the end portion of a cutter bar of a chain saw.

The saw chain 2 of FIG. 6 includes cutting links of the kind shown in FIG. 2. These cutting links are arranged in the saw chain as lefthand and righthand side links. The saw chain runs on a cutter bar of a chain saw (not shown) in the direction of arrow P.

The first lefthand cutting link 4 is pivotally connected with a first righthand connecting link 5 by means of forward and rearward pins or rivets 6, 7. The forward rivet 6 connects a first center drive link 8 with the cutting link 4 and the connecting link 5. The rear portion of drive link 8 has a rearward portion that projects between the links 4 and 5. The forward end of the drive link 8 is connected to second and third connecting links 10 by a further rivet 9. The two connecting links 10 are parallel to each other and are in turn connected to a second drive link 11. The drive link 11 is also connected to a righthand cutting link 12 and a fourth connecting link, the last two mentioned links being parallel to each other. Then follows a third center drive link 13, fourth and fifth connecting links 14 and a fourth center drive link (not illustrated). Thereafter, the saw chain arrangement described above follows beginning with a second lefthand cutting link.

Figure 1A:
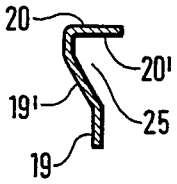
FIG. 1*a* is a partial section view taken along Ia—Ia of FIG. 1 and shows the channel for removing the chips cut by the cutting link.
Figure 1:
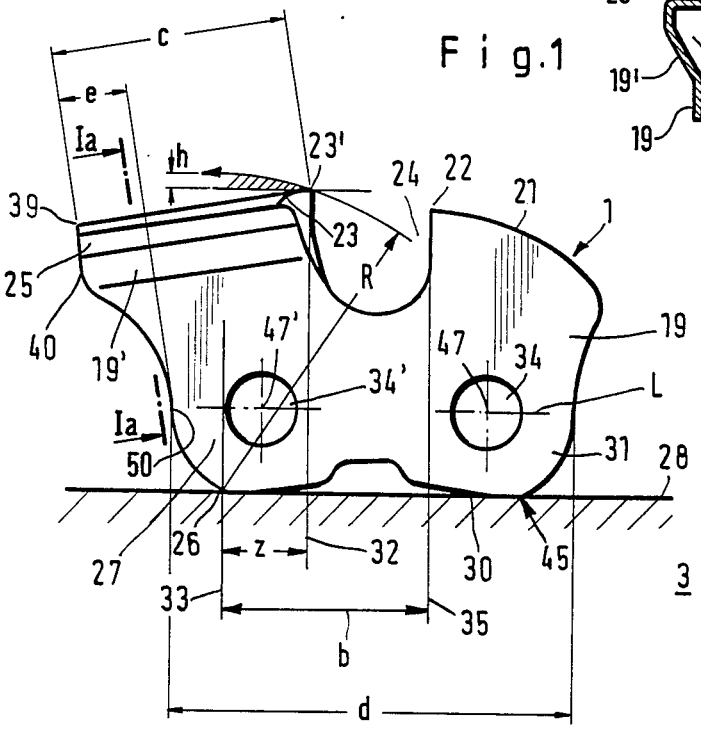
FIG. 1 is an elevation view of a cutting link of a saw chain of the invention.

The cuttibng link 1 of FIG. 1 has a plate-like body 19 and a roof-like cutting tooth 20 which extends upwardly from the plate-like body. The cutting tooth 20 extends laterally over the body 19 as shown in FIG. 1*a*. The cutting link has a forward wall that extends upwardly to define a depth limiter 21 disposed ahead of the cutting tooth 20. The body 19 has an approximately U-shaped chip slot 24 between the rearward end 22 of the depth limiter and the cutting edge 23 of the cutting tooth 20. Chips cut during cutting operations are directed away from the chain via the slot 24.

Before the cutting link 1 tilts upwardly during its cutting action, it lies with a forward edge portion 30 on a guide track 28 of the cutter bar 3. The edge portion 30 is part of the lower edge 45 of body 19 and defines the supporting surface of a forward foot 31 which lies in a common plane with the rearward tilt edge or tilt point 26 of a rearward foot 27. This plane extends in a direction parallel to a transverse plane L containing the axes 47 and 47' of forward and rearward openings 34 and 34', respectively, for accommodating connecting rivets (not shown). The plane L is transverse to the plane of the body 19. The manner in which the cutting link is supported acts against the tendency of the cutting tooth 20 to draw itself into the wood whereby vibration is reduced and a quieter operation of the chain saw is achieved.

The raising or tilting of the cutting link 1 about the rearward tilt edge 26 occurs when the cutting edge 23 is subjected to a force component as it penetrates the wood, the force component acting in a direction opposite to the direction P. At this instant and because of this action, the cutting link 1 requires a relatively large amount of energy from the chain saw motor whereby a correspondingly smaller amount of energy is available for the remaining cutting links of the saw chain 2. This leads to an irregular and impulse-like loading of the saw chain and the vibration associated therewith. According to the invention, the tilt displacement h for the cutting link 1 is held as small as possible to prevent the cutting link from tilting too much to thereby draw itself too far into the wood. Likewise, for the embodiment of FIGS. 2 to 5, the tilt displacement h is held as small as possible. In this way, a continuous cutting action is provided since the cutting links 1 and 1*a* to 5 cannot tilt an appreciable amount.

The tilt radius R of the cutting link 1 corresponds to the spacing of the rearward tilt edge 26 from the tip 23' of the cutting edge 23. The tilt edge 26 lies in a first vertical plane 33 which extends perpendicularly to the transverse plane L of the body 19. The forward tip 23' of the cutting edge 23 lies in a second vertical plane 32 which has only a small spacing from the rearward rivet opening 34'. The second vertical plane is parallel to the first vertical plane and perpendicular to the transverse plane L. The first vertical plane lies approximately tangentially to the rearward rivet opening 34'.

Referring still to FIG. 1, the first vertical plane 33 is spaced from the second vertical plane 32 only a small distance z which corresponds to approximately one-fourth of the length c of the cutting tooth 20. In this way, the tilt displacement h of cutting link 1 is substantially smaller than with known cutting links so that the vibration of the chain is very significantly reduced.

The length c of the cutting tooth 20 is approximately one-half of the length d of the body 19. The cutting tooth 20 and the adjacent wall portion 19' of body 19 conjointly define a chip channel 25 for guiding away chips cut from the wood. A channel guiding action is provided because the space available in the chip channel is reduced as a consequence of the tilting movement of the cutting link and the tilt displacement associated therewith whereby the wood chips which pass through channel 25 under the cutting tooth 20 impinge upon the lower surface 20' (FIG. 1*a*) of the cutting tooth 20 and thereby apply a reaction force to the cutting link. Under this reaction force, the cutting link 1 tilts about its tilt edge 26 of the rearward foot toward its initial position. Since the cutting tooth 20 shown in FIG. 1 is long, this reaction force has a greater effect. Thus with the cutting tooth 20 and its tail portion 40, the wood chips impinging thereagainst contribute to keeping the tilt displacement h small, the tilt displacement h being shown in FIG. 1.

The extended tail portion 40 also contributes to reducing vibration in the saw chain because of the above-described action of the wood chips.

Because the cutting link can only raise itself a small amount as a consequence of the relatively small distance z between the two vertical planes 32 and 33, the cutting edge 23 can move upwardly in the vertical direction by only a relatively small tilt displacement h and therefore does not penetrate appreciably into the wood. Accordingly, the force component acting on the cutting edge 23 during the cutting action is not significantly increased. Furthermore, the cutting operation proceeds continuously and wood chips of uniform size are cut.

Figure 8:
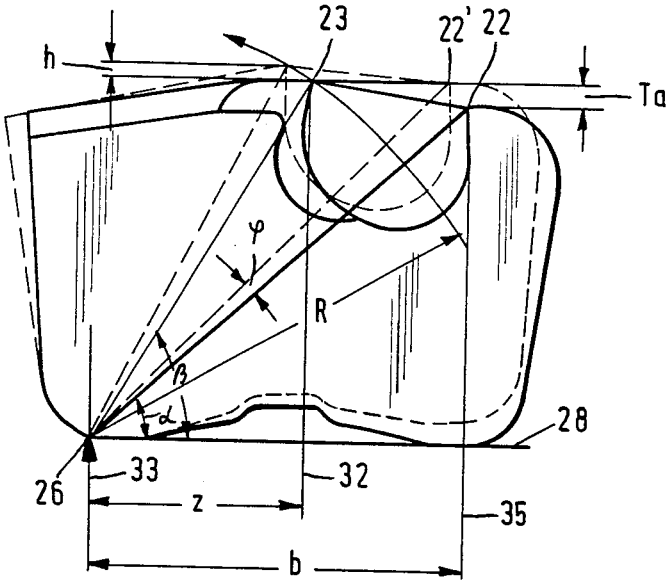
FIG. 8 is a side elevation view of a conventional cutting link in its untilted position and its tilted position, the latter being shown in phantom outline.

The tilt displacement h can be calculated from the following equation:

$$h = z \cdot \frac{T_a}{b} \cdot \frac{1 - \tan\frac{\phi}{2} \cdot \tan\beta}{1 - \tan\frac{\phi}{2} \cdot \tan\alpha}$$

which can be approximated by:

$$h \cong z \cdot \frac{T_a}{b}$$

and for which the quantities are shown in FIG. 8, the quantities being for a new cutting link not yet subjected to wear. The quantity $T_a$ is measured in a direction perpendicular to the longitudinal direction of the cutting link. This quantity $T_a$ is the difference between the elevation of the rearward end 22 of the depth limiter in the initial position of the cutting link and the elevation of rearward end 22' of the depth limiter in the tilted position of the cutting link. The quantity b is the distance between a third vertical plane 35 containing the end 22 of the depth limiter and the first vertical plane 33. The ratio of $T_a$ to b is constant. The angle $\alpha$ is the angle between the cutter bar guide track 28 and a straight line connecting the tilt edge 26 with the end 22 of the depth limiter for the initial or untilted position of the cutting link. The angle $\beta$ is the angle which is defined by the cutter bar guide track 28 and a straight line connecting the tilt edge 26 with the cutting edge 23. The angle $\phi$ is the angle between the straight lines which connect the rearward tilt edge 26 with the depth limiter ends 22 and 22' in the untilted and tilted positions of the cutting link, respectively. The tilt displacement h designates the elevation to which the cutting tooth can penetrate wood during the tilting action because of its geometric dimensions. The tilt displacement h is preferably 0.25 mm for a cutting link in the new condition.

Referring to FIG. 1, the cutting tooth 20 is relatively long and includes the tail portion 40 which projects outwardly in the rearward direction so that it extends beyond and over the rearward edge 50 of the body 19 of the cutting link. The length e of the tail portion 40 is approximately one-third of the length c of the cutting tooth 20.

Because of the tail portion 40, the tendency of the saw chain to produce a kickback condition is very substantially reduced.

Figure 7:
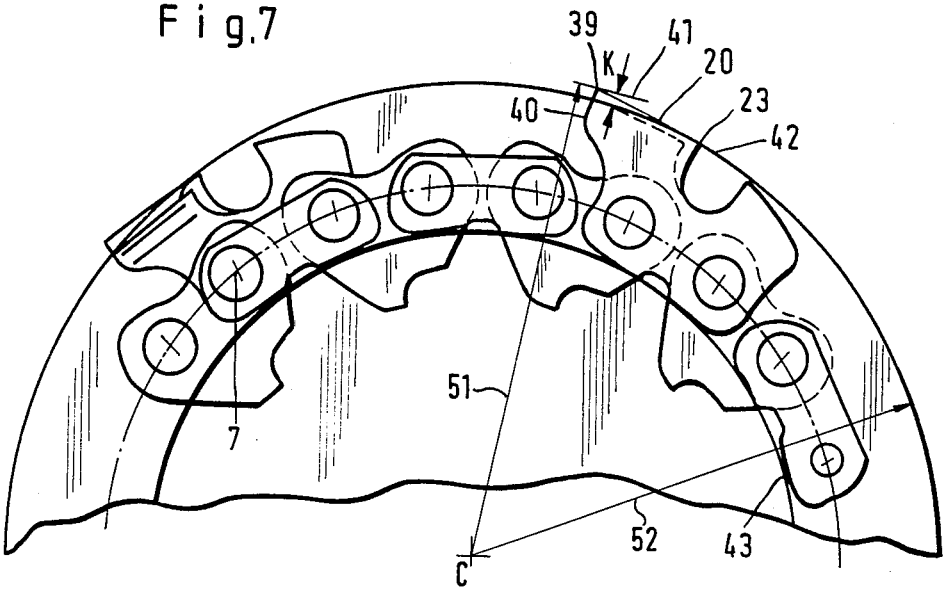
FIG. 7 shows a saw chain equipped with the cutting link of FIG. 1 as it moves over the end portion of a cutter bar of a chain saw.

Referring now to FIG. 7, reference letter C designates the curvature center of the rounded end 43 of a cutter bar. Reference numeral 42 designates the curved path defined by the cutting edge 23 as it moves around the rounded end 43 and reference numeral 41 is a segment of the curved path defined by the rearward tip 39 of the tail portion 40. The curved paths 42 and 41 likewise having their centers at point C. FIG. 7 shows that the radius 51 of path 41 is greater than the radius 52 of the path 42 and path 41 of the rearward tip 39 of tail portion 40 lies outwardly beyond the path 42 by a projecting amount K. Accordingly, when the person operating the chain saw thrusts the same with the cutter bar into wood so that the front end thereof penetrates the wood, it is the tail portion 40 which strikes the wood before the cutting edge 23.

Because of this configuration, the cutting link cannot dig itself into the wood. The projecting amount K must first be traversed and overcome by the application of a forward thrust by the operator during the cutting operation before the cutting link 1 can cut with its cutting edge. As a consequence of this situation, a very substantial reduction in kickback is obtained.

Figure 4:
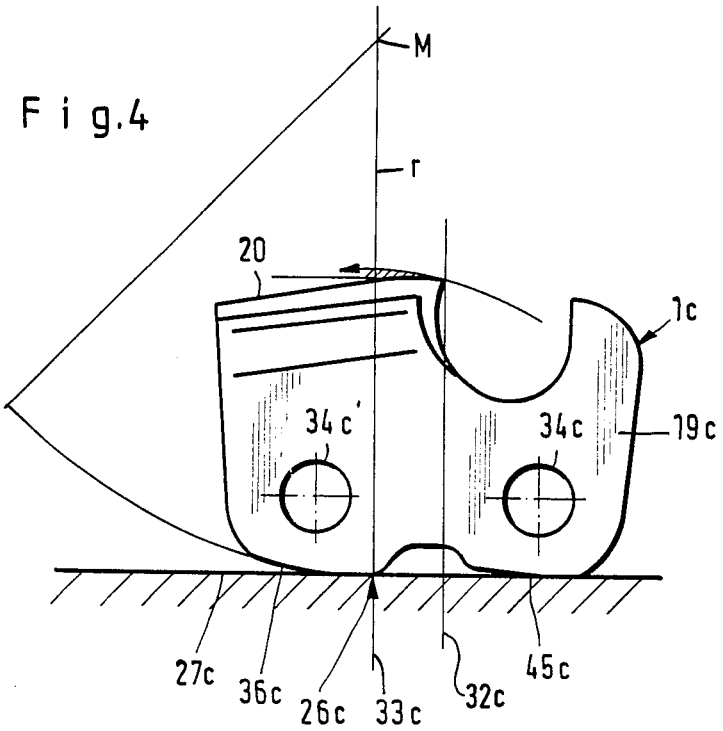
FIGS. 2 to 5 are respective side elevation views of alternate embodiments of the cutting link.
Figure 3:
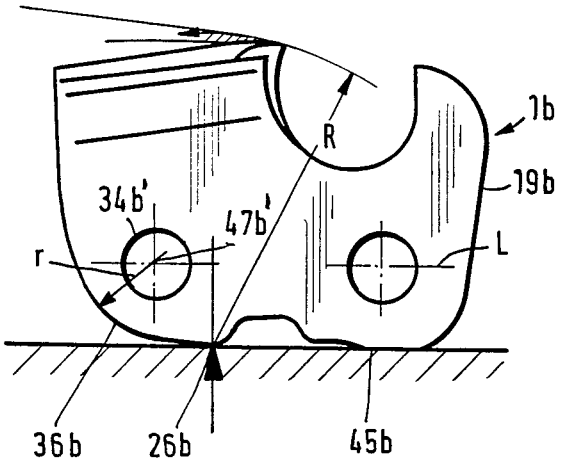

In the embodiments shown in FIGS. 2 to 4, the distance z is so selected that the above equation is fulfilled and that the tilt displacement h is approximately 0.25 mm. The cutting links 1*a* to 1*c* differ from the cutting link 1 of FIG. 1 essentially in that firstly: they each have an inclined edge surface extending rearwardly from the tilt edge (26*a* to 26*c*) on the rearward foot; and secondly: the cutting teeth do not include a tail portion which projects outwardly beyond the body of the cutting link.

The second vertical planes 32*a* to 32*c* of these embodiments lie approximately midway between the linkage rivet openings 32*a* to 34*c* and 34*a'* to 34*c'*. The distance z between the first and second vertical planes 33*a* and 32*a* is approximately equal to a third of the length c of the cutting tooth 20*a*.

FIG. 2 shows that an upwardly inclined edge portion 36*a* extends directly from the tilt edge 26*a* of the rearward foot 27*a*. The edge portion 36*a* constitutes part of the lower edge 45*a* of the body 19*a*. This edge portion 36*a* defines a linear inclined edge surface which runs parallel to a plane 37*a* which is common to the tip 23*a'* of the cutting edge 23*a* and rearward end 22*a* of the depth limiter. The edge portion 36*a* and the cutter bar guide track 28*a* conjointly define an angle $\gamma$ of 7°. Because of this configuration, the edge portion 36*a* defines a supporting edge surface upon which the cutting link can support itself on the guide track 28*a* of the cutter bar when it tilts about the tilt edge 26*a*.

The cutting links 1*b* and 1*c* of FIGS. 3 and 4, respectively, differ from the cutting link of FIG. 2 only in that the edge portions 36*b* and 36*c* are each curved to define portions of a circle. The edge portions 36*b* and 36*c* likewise are respective portions of the longitudinally extending lower edges 45*b* and 45*c*.

For cutting link 1*b*, the rearward end edge portion 36*b* is curved about axis 47*b'* of the rearward rivet opening 34*b'* and has a relatively small radius of curvature r. The quantity r is preferably less than the distance of the tilt edge 26*b* to the transverse plane L of the body 19*b*.

Because of this configuration, the rear linkage rivet of the cutting link of the saw chain does not have to undergo a vertical displacement when the cutting link tilts about its tilt edge. In this way, additional movements which could cause vibration of the saw chain in the vertical and horizontal planes are avoided.

The curved end edge portion 36*c* of cutting link 1*c* of FIG. 4 is curved to have a substantially larger radius of curvature r than the end edge portion 36*b* of the cutting link 1*b*. Further, the tilt edge 26*c* of the cutting link 1*c* in a first vertical plane 33*c* in front of the rearward linkage rivet opening 34*c'*. The center M of the radius of curvature lies outside of the body 19*c* in the first vertical plane 33*c* and is twice as long as the distance of the tilt edge 26*c* from the cutting tooth 20*c* measured in the vertical direction. Because of the end edge portion 36*c* of the rearward foot 27*c*, cutting link 1*c* can tilt about its tilt edge 26*c* smoothly and continuously without causing the rearward linkage rivet to shift substantially in its horizontal position. Furthermore, an unnecessary stimulus to the vibration of the saw chain is prevented.

Figure 5:
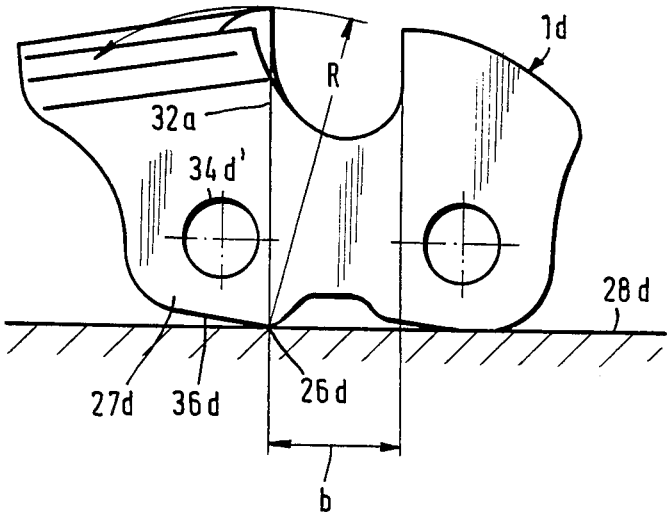

The cutting link 1*d* of FIG. 5 differs from the cutting link of FIG. 1 in that the rearward foot 27*d* has a tilt surface 36*d* by means of which the cutting link lies upon guide track 28*d* of the cutter bar during the tilting action. The tilt surface 36*d* is configured so as to correspond to the cutting link 1*a* of FIG. 2. It therefore defines an inclined surface which extends from the tilt edge 26*d* upwardly and toward the rear. Accordingly, the tilt edge 26*d* lies in the second vertical plane 32*d* which is tangential to the rearward linkage rivet opening 34*d'*. Stated otherwise, in this embodiment, the dimension z is zero. In this way, the cutting link 1*d* has the smallest possible tilt displacement. In this embodiment also, the rearward edge portion of the rearward foot 27*d* can be rounded to define a circular segment corresponding to the edge portions 36*b* and 36*c* of the cutting links 1*b* and 1*c*.

It is understood that the foregoing description is that of the preferred embodiments of the invention and that various change and modifications may be made thereto without departing from the spirit and scope of the invention, as defined in the appended claims.

What is claimed is:

1. A saw chain for a power-driven chain saw having a cutter bar defining a track for accommodating and guiding the saw chain, the saw chain comprising:

a plurality of cutting links, a plurality of connecting links, and a plurality of driving links, the links being pivotally interconnected by rivets or the like to define the saw chain, each of the cutting links including:

a plate-like body having a rearward wall defining a rearward opening for accomodating one of the rivets and a forward wall defining a forward opening for accommodating an other one of the rivets, said openings defining respective linkage axes about which the cutting link pivots relative to the respective links to which it is directly connected; said linkage axes defining a plane transverse to said plate-like body;

the rearward wall having an upwardly extending bent-over top portion defining the cutting tooth of the cutting link and a downwardly extending portion defining the rearward foot of the cutting link, the cutting tooth being elongated and having a forward end defining the cutting edge thereof;

the forward wall having an unwardly extending portion defining the depth limiter of the cutting link and having a downwardly extending portion defining the forward foot of the cutting link; said cutting edge being at a first elevation with respect to the cutter bar when both of said feet are in sliding contact with the base of the track of the cutter bar;

said rearward foot having a peripheral edge extending downwardly beneath said transverse plane so as to define a single point whereat said rearward foot slidingly engages the track as the saw chain moves therealong, said point being a tilt point about which the cutting link tilts to displace said cutting edge to a second elevation above said first elevation when said cutting tooth penetrates the wood to be cut, the difference between said elevations being the tilt displacement (h) of said cutting edge, said tilt point being formed on said rearward foot at a location thereon such that said tilt point lies between a first vertical plane passing through said rearward opening and a second vertical plane passing through said cutting edge thereby reducing said tilt displacement to a predetermined magnitude, said first and second vertical planes being approximately perpendicular to said transverse plane.

2. The saw chain of claim 1, said tilt point being located on said rearward foot so as to cause said tilt point to lie in a vertical plane passing through the forward third of said cutting tooth.

3. The saw chain of claim 1, said tilt point being located on said rearward foot so as to cause said tilt point to lie in a vertical plane which is approximately tengential to said rearward opering of said plate-like body.

4. The saw chain of claim 1, at least a part of said cutting edge being in a second vertical plane parallel to said firstmentioned vertical plane, said second vertical plane being forward of said rearward opening, said second vertical plane lying approximately midway between said forward and rearward openings, and said first vertical plane lying forward of said rearward opening.

5. The saw chain of claim 1, at least a part of said cutting edge being in a second vertical plane parallel to said firstmentioned vertical plane, the spacing between said planes being selected so that said tilt displacement h is not greater than 0.25 mm.

6. The saw chain of claim 5, said depth limiter having a rearward end that is likewise displaced in elevation when the cutting link tilts about said tile edge, the displacement of said rearward end in the vertical direction being designated by $T_a$, the rearward end of said depth limiter lying in a third vertical plane spaced from said first vertical plane a distance b, the ratio of $T_a/b$ being a constant.

7. The saw chain of claim 1, the portion of said rearward wall beneath said cutting tooth and said depth limiter conjointly defining the body of said cutting link, said cutting tooth having a tail portion extending out beyond the rearward edge of said body.

8. The saw chain of claim 7, said tail portion having a length corresponding to approximately a third of the length of the entire cutting tooth.

9. The saw chain of claim 1, the portion of said rearward wall beneath said cutting tooth and the portion of said forward wall beneath said depth limiter conjointly defining the body of said cutting link, said body including said rearward foot and said forward foot;

said body having a lower edge extending over the entire length of said body and defining the outline of said forward foot and said rearward foot; and a portion of the lower edge defining a forward supporting surface at said forward foot for supporting said cutting link on the guide track of the cutter bar.

10. The saw chain of claim 9, said forward supporting surface and said tilt point being in a common plane.

11. The saw chain of claim 10, said common plane being approximately parallel to said transverse plane.

12. The saw chain of claim 9, said lower edge including a rearward edge portion extending inclined upwardly and rearwardly from said tilt point.

13. The saw chain of claim 12, said cutting edge and the rearward tip of said depth limiter conjointly defining a plane inclined with respect to the guide track of the cutter bar, said rearward edge portion being linear and approximately parallel to said inclined plane.

14. The saw chain of claim 12, said rearward edge portion being curved to correspond to a segment of a circle.

15. The saw chain of claim 14, said rearward edge portion being a segment of a circle having the center of its radius of curvature at the linkage axis defined by said rearward opening.

16. The saw chain of claim 14, said rearward edge portion being a segment of a circle having the center of its radius of curvature at a location outside of the outline of said cutting link and above said cutting tooth.

17. The saw chain of claim 16, said center lying in said vertical plane.

18. The saw chain of claim 17, said center being disposed in said vertical plane at a distance above said tilt edge corresponding approximately to twice the distance between said tilt edge and said cutting tooth.

19. The saw chain of claim 13, said rearward edge portion and said guide track conjointly defining an angle approximately 6° to 10°.

20. The saw chain of claim 1, at least a part of said cutting edge being in a second vertical plane parallel to said first-mentioned plane, said second vertical plane being forward of said rearward opening, said first plane and said second plane being coincident so as to cause said tilt edge to lie in the same plane with said part of said cutting edge.

21. The saw chain of claim 20, said coincident planes being tangent to said rearward opening.

22. A saw chain for a power-driven chain saw having a cutter bar defining a track for accommodating and guiding the saw chain, the cutter bar having an outer end defining a predetermined curvature for the guide track, the saw chain comprising:

a plurality of cutting links, a plurality of connecting links, and a plurality of driving links, the links being pivotally interconnected by rivets or the like to define the saw chain, the cutting links including:

a plate-like body having a rearward wall defining a rearward opening for accommodating one of the rivets and a forward wall defining a forward opening for accommodating an other one of the rivets, said openings defining respective linkage axes about which the cutting link pivots relative to the respective links to which it is directly connected;

the rearward wall having an upwardly extending bent-over top portion defining the cutting tooth of the cutting link and a downwardly extending portion defining the rearward foot of the cutting link, the cutting tooth being elongated and having a forward end defining the cutting edge thereof;

the forward wall having an upwardly extending portion defining the depth limiter of the cutting link and having a downwardly extending portion defining the forward foot of the cutting link;

the portion of said rearward wall beneath said cutting tooth and the portion of said forward wall beneath said depth limiter conjointly defining the body of said cutting link, said cutting tooth having a tail portion extending out beyond the rearward edge of said body;

said cutting edge and the outermost tip of said tail portion defining respective circular paths around the outer end of the cutter bar having the same center of curvature as the guide track, the circular path of said outermost tip having a larger radius of curvature that the circular path of said cutting edge thereby causing said outermost tip to strike the wood before said cutting edge when the operator thrusts the cutter bar into the wood to be cut whereby the tendency of an unwanted kickback action to occur is reduced;

said linkage axes defining a plane transverse to said plate-like body; said cutting edge being at a first elevation with respect to the cutter bar when both of said feet are in sliding contact engagement with the base of the track of the cutter bar; said rearward foot having a peripheral edge extending downwardly beneath said transverse plane so as to define a single point whereat said rearward foot slidingly engages the track as the saw chain moves therealong, said point being a tilt point about which the cutting link tilts to displace said cutting edge to a second elevation above said first elevation when said cutting tooth penetrates the wood to be cut, the difference between said elevations being the tile displacement of said cutting edge, said tilt point lying in a vertical plane approximately perpendicular to said transverse plane; and said tilt point being formed on said rearward foot at a location thereon such that said vertical plane lies within the forward half of said cutting tooth thereby reducing said tilt displacement to a predetermined magnitude.

* * * * *

UNITED STATES PATENT AND TRADEMARK OFFICE

CERTIFICATE OF CORRECTION

PATENT NO. : 4,573,386

DATED : March 4, 1986

INVENTOR(S) : Bernd Lindemann, Götz Landwehr & Hans-Georg Kaiser

It is certified that error appears in the above-identified patent and that said Letters Patent is hereby corrected as shown below:

On the title page of the patent, under the heading "Foreign Application Priority Data": delete "3235317" and substitute -- 3225317 -- therefor.

In the 13th line of the Abstract: delete "traverse" and substitute -- transverse -- therefor.

In column 1, line 50: delete "accomodating" and substitute -- accommodating -- therefor.

In column 1, line 57: delete "accomodating" and substitute -- accommodating -- therefor.

In column 1, line 58: delete "accomodating" and substitute -- accommodating -- therefor.

In column 1, line 62: delete "defines" and substitute -- define -- therefor.

UNITED STATES PATENT AND TRADEMARK OFFICE

CERTIFICATE OF CORRECTION

PATENT NO. : 4,573,386

DATED : March 4, 1986

INVENTOR(S) : Bernd Lindemann, Götz Landwehr & Hans-Georg Kaiser

It is certified that error appears in the above-identified patent and that said Letters Patent is hereby corrected as shown below:

In column 2, line 10: delete "when said" and substitute -- when the -- therefor.

In column 2, line 13: delete "said cutting" and substitute -- the cutting -- therefor.

In column 2, line 15: delete "tolt" and substitute -- tilt -- therefor.

In column 2, line 16: delete "said vertical" and substitute -- the vertical -- therefor.

In column 2, line 59: add the word -- saw -- before the word "chain".

In column 3, line 27: delete "cuttibng" and substitute -- cutting -- therefor.

UNITED STATES PATENT AND TRADEMARK OFFICE

CERTIFICATE OF CORRECTION

PATENT NO. : 4,573,386

DATED : March 4, 1986

INVENTOR(S) : Bernd Lindemann, Götz Landwehr & Hans-Georg Kaiser

It is certified that error appears in the above-identified patent and that said Letters Patent is hereby corrected as shown below:

In column 6, line 8: delete "openings 32a" and substitute -- openings 34a -- therefor.

In column 6, line 46: add the word -- lies -- after the words "cutting link 1c".

In column 7, line 9: delete "change" and substitute -- changes -- therefor.

In column 7, line 36: delete "unwardly" and substitute -- upwardly -- therefor.

In column 8, line 1: delete "tengen-" and substitute -- tangen- -- therefor.

In column 8, line 2: delete "opering" and substitute -- opening -- therefor.

UNITED STATES PATENT AND TRADEMARK OFFICE

CERTIFICATE OF CORRECTION

PATENT NO. : 4,573,386

DATED : March 4, 1986

INVENTOR(S) : Bernd Lindemann, Götz Landwehr & Hans-Georg Kaiser

It is certified that error appears in the above-identified patent and that said Letters Patent is hereby corrected as shown below:

In column 8, line 18: delete "tıle" and substitute -- tilt -- therefor.

In column 10, line 14: delete "that" and substitute -- than -- therefor.

In column 10, line 33: delete "tile" and substitute -- tilt -- therefor.

Signed and Sealed this

*Twenty-ninth* Day of *July 1986*

[SEAL]

*Attest:*

*Attesting Officer*

DONALD J. QUIGG

*Commissioner of Patents and Trademarks*